US005155290A

United States Patent [19]

Hawke

[11] Patent Number: 5,155,290

[45] Date of Patent: Oct. 13, 1992

[54] PREVENTION OF BREAKDOWN BEHIND RAILGUN PROJECTILES

[75] Inventor: Ronald S. Hawke, Livermore, Calif.

[73] Assignee: The United States of America as represented by the United States Department of Energy, Washington, D.C.

[21] Appl. No.: 783,664

[22] Filed: Oct. 28, 1991

Related U.S. Application Data

[62] Division of Ser. No. 341,019, Apr. 20, 1989, Pat. No. 5,142,962.

[51] Int. Cl.[5] ..... F42B 6/00

[52] U.S. Cl. ..... 89/8; 124/3

[58] Field of Search ..... 89/8; 124/3

[56] References Cited

U.S. PATENT DOCUMENTS 4,433,607 2/1984 Kemeny ..... 89/8

4,621,561 11/1986 Weldon ..... 89/8

FOREIGN PATENT DOCUMENTS 251799 10/1988 Japan ..... 2/2.5

OTHER PUBLICATIONS

Hawke R. S., "Railgun Development for EOS Applications; A Status Report", UCRL-96479, Jun. 30, 1987.

Webster's New World Dictionary, College Edition, "Transpiration", p. 1548, 1957.

Thio, Y. C., Feasibility Study of a Railgun as a Driver for Impact Fusion, DOE/ER/13048-3, Jun. 1986, pp. 6-1-6-5.

*Primary Examiner*—Stephen C. Bentley

*Attorney, Agent, or Firm*—Miguel A. Valdes; Henry P. Sartorio; William R. Moser

[57] ABSTRACT

An electromagnetic railgun accelerator system, for accelerating projectiles (14, 15, 114, 214, 314, 414) by a plasma arc (3), introduces a breakdown inhibiting gas into the railgun chamber (26) behind the accelerating projectile (14). The breakdown inhibiting gas, which absorbs electrons, is a halide or a halide compound such as fluorine or $SF_6$. The gas is introduced between the railgun rails (12) after the projectile (14) has passed through inlets (16) in the rails (12) or the projectile (114); by coating the rails (12) or the projectile (15) with a material (28) which releases the gas after the projectile (14) passes over it; by fabricating the rails (12) or the projectile (15) or insulators out of a material which releases the gas into the portions of the chamber (26) through which the projectile has travelled. The projectile (214, 314, 414) may have a cavity (232, 332, 432) at its rear to control the release of ablation products (4).

9 Claims, 4 Drawing Sheets

PREVENTION OF BREAKDOWN BEHIND RAILGUN PROJECTILES

The Government has rights in this invention pursuant to Contract No. W-7405-ENG-48 awarded by the U.S. Department of Energy.

This is a division of application Ser. No. 07/341,019 filed Apr. 20, 1989, now U.S. Pat. No. 5,142,962, issued Sep. 1, 1992.

TECHNICAL FIELD

The present invention broadly relates to electromagnetic railgun accelerators and more particularly to an apparatus and method for preventing or reducing restrike behind a railgun propulsive plasma arc.

BACKGROUND ART

Railgun accelerators have met with limited success in accelerating projectiles of from 1 gram to about 1 kilogram to velocities of about 7 km/s. Referring to FIG. 1*a*, a railgun accelerator having a pair of parallel spaced apart conducting rails 1, accelerates a projectile 2 located between the rails 1, by establishing a high current plasma arc or armature 3 between the rails 1, behind the projectile 2.

Under ideal conditions, there is only one current conduction path from rail to rail and it is located immediately behind the projectile 2. The magnetic fields from the currents in the rails 1 couple with the current in the armature and results in a Lorentz force on the plasma, which then results in a hydrodynamic acceleration pressure on the projectile 2.

In reality, arc growth and separation are aggravated by barrel-wall ablation 4 as illustrated in FIG. 1*b*. Referring also to FIG. 1*c*, while the projectile 2 continues to be accelerated as it and the plasma arc 3 move down the rails 1, gradual erosion of the launcher causes a secondary arc, or restrike 5, to form in the debris left behind by the first armature 3.

The secondary arc 5 may form right behind the neutral ablation products 4 of the first armature 3 or it may form farther towards the breech of the launcher where the rail-to-rail voltage is higher and the pressure is lower. In either situation, the secondary arc 5 is undesirable because it reduces the propulsive capability of the railgun, thereby limiting the railgun operating velocity.

Specifically, the secondary arc 5 shunts current away from the primary, propulsive, plasmic arc 3 employed to propel the projectile 2. The projectile acceleration force, F, diminishes with the current, I, squared: $F=L'I^2/2$, where L' is the inductance gradient of the rail pair. Hence, the propulsive force rapidly decreases as the shunt current grows.

Efforts have been made to accelerate projectiles at velocities greater than 8 to 9 km/s. However, as the velocities increase, the problem of restrike becomes more prevalent and high velocities are difficult to obtain.

In *Railgun Development for EOS Applications: A Status Report*, by R. S. Hawke, the article discloses that restrike can be reduced by filling the railgun bore with pure hydrogen after the projectile passes. The article, however, does not disclose the ways in which the hydrogen is introduced into the bore, the use of other gases besides hydrogen, or that the projectile itself may be designed to reduce restrike such that gas need not be injected into the railgun.

SUMMARY OF THE INVENTION

The invention is a method and apparatus for preventing secondary voltage breakdown or restrike behind a railgun projectile while it is being accelerated by a plasma arc prior to launch. The breakdown voltage is sensitive to localized pressure, temperature, and gas composition Introducing a breakdown inhibiting gas into the railgun barrel after the projectile and plasma arc pass creates conditions between the rails to reduce the effect or prevent secondary breakdown.

Breakdown inhibiting gas is introduced between the rails after passage of the projectile and plasma arc by barrel preparation, projectile preparation, or by injection. The breakdown inhibiting gas which absorbs, or gathers electrons is any halogen (fluorine, chlorine, iodine, bromine or astatine) or compound containing one or more halogen atoms. Since fluorine is the most active halide, it has the strongest affinity for electrons and hence, is preferred.

The gas may be injected between the rails after passage of the projectile and arc; by fabricating the barrel with a material which releases breakdown inhibiting gas when heated; by applying a film, which vaporizes as the plasma arc passes over it, over the portions of the railgun accelerator which are in contact with the plasma arc; and by injecting the gas through inlets in the rails.

In addition, restrike can be eliminated or reduced without preparing the barrel or injecting gas by fabricating the projectile out of a material which releases a breakdown inhibiting gas as the projectile is accelerated by the plasma arc; by treating the projectile with a material which releases a breakdown inhibiting/gas as the projectile is accelerated; by configuring the projectile to have a cavity at its rear end; and by providing inlets in the projectile to permit the gas to flow therefrom upon acceleration.

It is therefore a primary object of the present invention to provide a method and apparatus for reducing or eliminating secondary voltage breakdown or restrike in a railgun accelerator.

These, and further objects of the invention will become apparent or will be clear during the following description of a preferred embodiment of the present invention.

BRIEF DESCRIPTION OF THE DRAWINGS

In the accompanying drawings

DESCRIPTION OF THE PREFERRED EMBODIMENTS

Figure 1A:
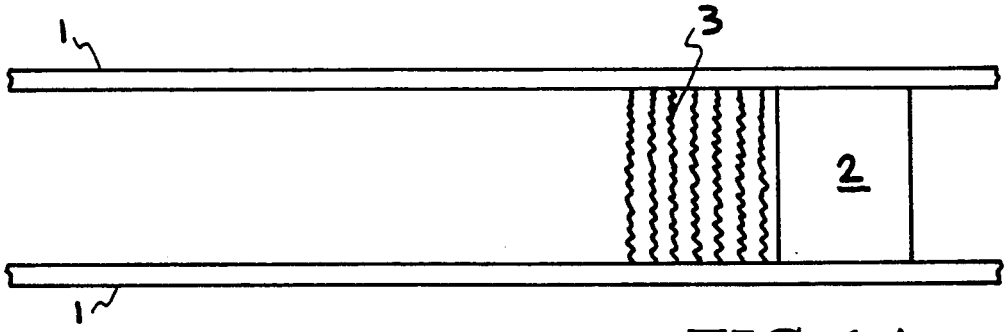
FIG. 1A (PRIOR ART)
FIG. 1*a* is a perspective view of an ideal railgun projectile accelerated by a plasma arc.
Figure 1B:
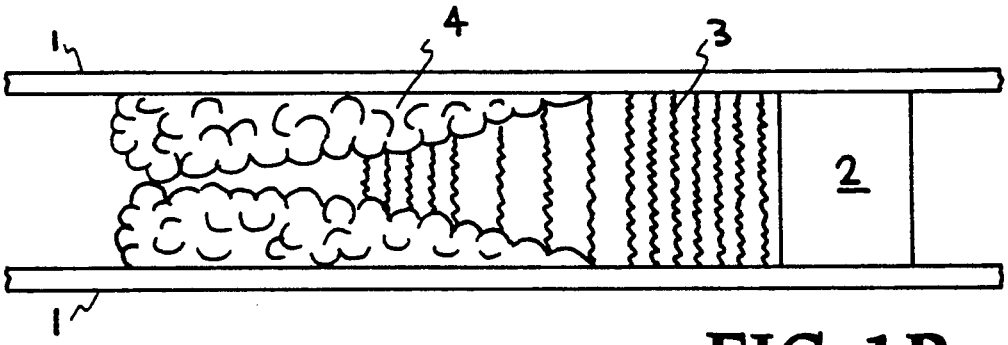
FIG. 1B (PRIOR ART)
FIG. 1*b* is a perspective view of the railgun projectile of FIG. 1*a* in the presence of wall ablation.
Figure 1C:
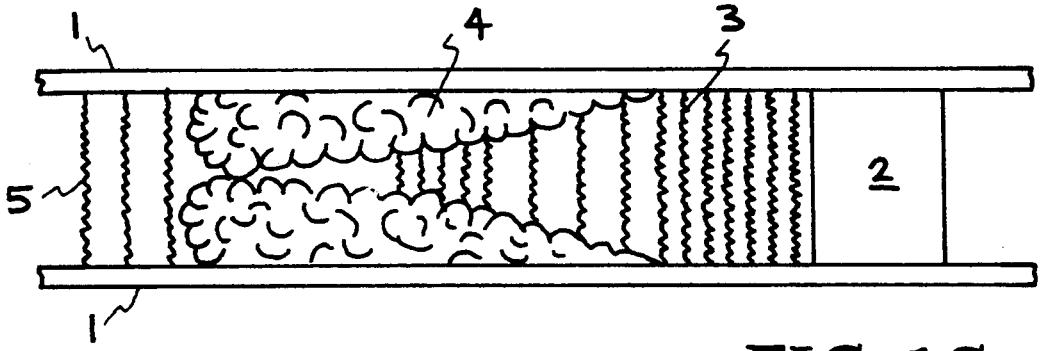
FIG. 1C (PRIOR ART)
FIG. 1*c* is a perspective view of the railgun projectile of FIG. 1*a* in the presence of secondary restrike.
Figure 2:
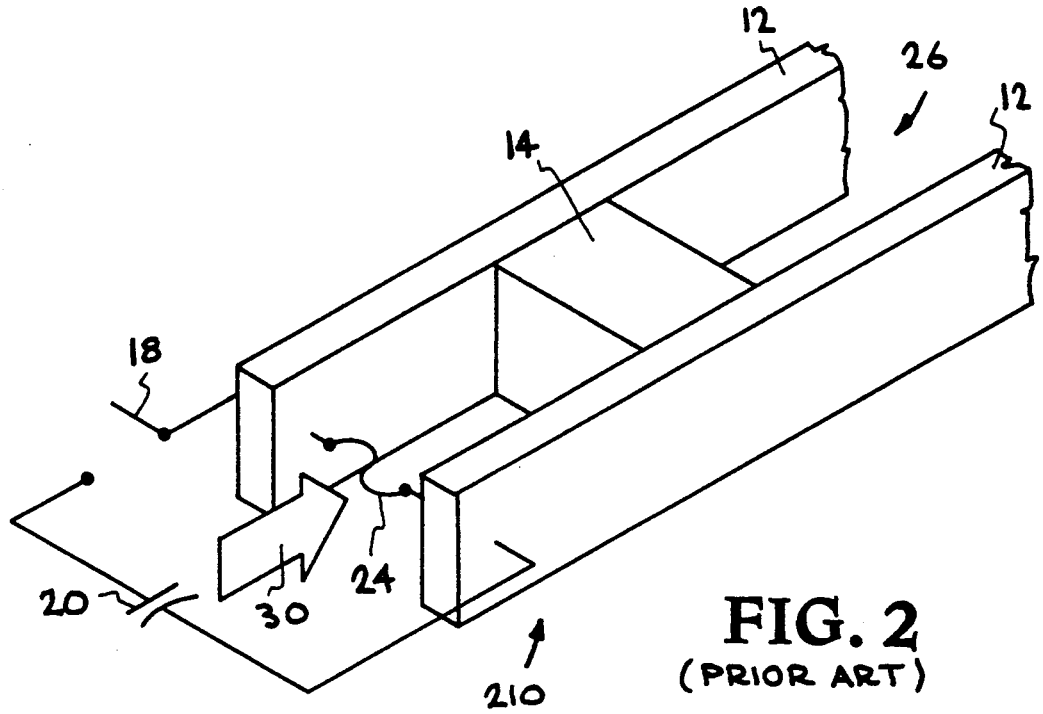
FIG. 2 (PRIOR ART)
FIG. 2 is a perspective view of a prior art railgun for reducing secondary restrike.

Referring to FIG. 2, the prior art railgun apparatus 210 for accelerating a projectile 14 and reducing the effect of restrike is shown. Railguns 210 are well known in the art, examples of particular railguns having been patented in the U.S. Pat. No. 4,343,223, Hawke, "Multiple Stage Railgun" and U.S. Pat. No. 4,706,542, Hawke, "Low Voltage Arc Formation in Railguns", incorporated herein by reference.

In a railgun accelerator system 10 having a pair of parallel conducting rails 12 which are spaced apart by insulators (not shown) which together form a railgun chamber or barrel 26, a projectile 14 is accelerated through the chamber 26. The projectile 14 is accelerated by initiating a closure of a contact switch 18 so that a primary energy storage device 20 (shown as a capacitor) will discharge and cause a fuse 24 to vaporize and initiate a plasma arc (not illustrated) behind the projectile. In order to increase the projectile's acceleration speed, hydrogen 30 is used as an injection gas to accelerate the projectile 14. The gas 30 can be injected by a single-stage or a two-stage light-gas gun which automatically injects the gas 30 behind the projectile 14' at the same velocity. The gas 30 continues to follow closely behind the plasma arc up to approximately 12 km/s, in two-stage light-gas gun. The gas pressure behind the plasma arc is estimated to be about 1500 psi but, the higher the pressure and temperature, the more likely it is to follow the higher velocities.

As the projectile 14 and plasma arc move down the rails 12, a voltage across the rails 12 may increase to the point where a secondary plasma arc occurs as a by-product of the primary arc. The breakdown voltage is sensitive to the composition of gases and localized pressure. As previously discussed, *Railgun Development for EOS Applications* discloses that restrike may be reduced by injecting pure hydrogen gas 30 into the barrel 26 behind the projectile 14 and plasma arc to insulate the rails 12.

Figure 3:
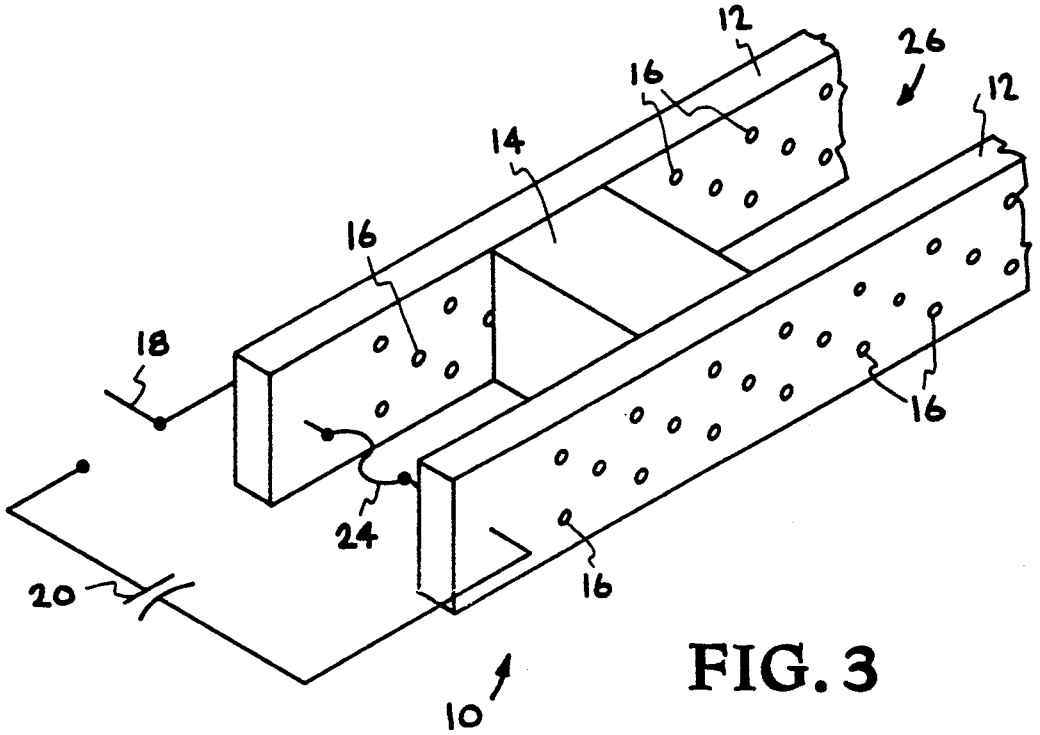
FIG. 3 is a perspective view of a railgun apparatus for reducing secondary restrike.

Referring to FIG. 3, a breakdown inhibiting gas (not illustrated) which absorbs or gathers electrons, is introduced into the railgun barrel 26, behind the accelerating projectile 14 to electrically insulate the rails 12. The breakdown inhibiting gas collects electrons so that restrike is eliminated or minimized. The breakdown inhibiting gas is a gas other than pure hydrogen. It is also a low temperature injection gas. In the preferred embodiment, the gas may be any halogen (fluorine, chlorine, iodine, bromine or astatine) or a compound containing one or more halogen atoms.

However, since fluorine is the most active halogen, it has the strongest affinity for electrons. Hence, fluorine or fluorine compounds, such as $SF_6$ or FREON, are preferred. They may be mixed with the injection gas 30—hydrogen, helium or nitrogen, to make the acceleration gas more an effective insulating gas.

However, the above-referenced article does not disclose that halogens or compounds containing one or more halogen atoms are more effective in eliminating and/or reducing restrike; the modes in which the gas is introduced into the railgun barrel behind the projectile; and that the projectile may be designed to reduce/eliminate restrike.

While the prior art injects pure hydrogen into the barrel 26 behind the projectile 14, hydrogen and halogens are members of different chemical groups and do not have similar properties.

As illustrated in FIG. 3, there are a plurality of inlets, pores, or nozzles 16 along the rails 12 for feeding the breakdown inhibiting gas (not illustrated) into the railgun chamber 26 after the projectile 14 has been accelerated by the plasma arc.

The inlets 16 may be plugged up with a wax, grease, or oil which vaporizes as the hot plasma arc passes over it. As the plasma arc and the projectile 14 move down the railgun chamber 26, current flows through the rails 12 and heats them, causing the wax, grease, or oil to vaporize, thereby allowing the gas to freely pass through the pores 16 and into the chamber 26. The gas is not released into the railgun chamber 26 until after the arc and the projectile 14 have passed.

Figure 4:
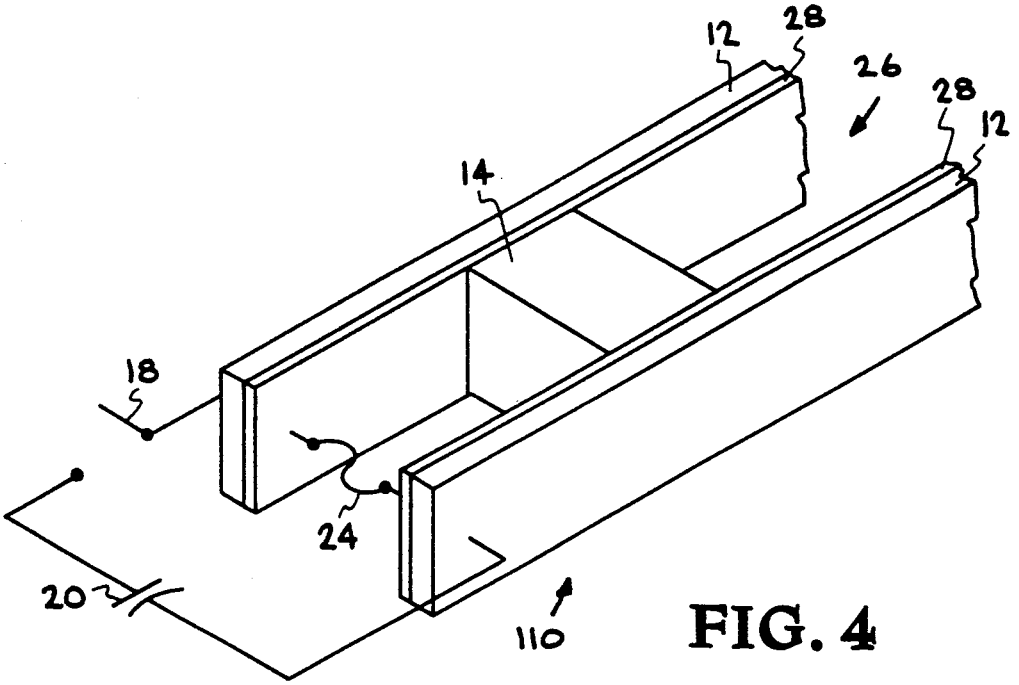
FIG. 4 is a perspective view of another railgun apparatus for reducing secondary restrike.

Referring to FIG. 4, another embodiment of the invention is illustrated. The portions of the railgun 110 barrel which come in contact with the plasma arc are coated with a material 28 containing the breakdown inhibiting gas so that it forms an insulation layer which vaporizes when the plasma arc passes over it. When the material 28 vaporizes, the breakdown inhibiting gas vapors are introduced into the railgun chamber 26 thereby reducing or eliminating restrike.

Alternatively, the rails 12 of the railgun barrel 110 may be fabricated out of a material containing a breakdown inhibiting gas such that when the rails are heated by the plasma arc, the material 28 vaporizes and a breakdown inhibiting gas passes into the barrel chamber 26. Similarly, the rails, the insulators (not illustrated), or both may be impregnated with the breakdown inhibiting gas by exposing them to a breakdown inhibiting gas under high pressure to force the gas to diffuse into the surface of the material. Again, when the chamber 26 heats up, the breakdown inhibiting gas is released. This technique is referred to as transpiration. When the rails 12 are heated, the material perspires filling the chamber 26 and/or coating the surface of the rails 12 with the breakdown inhibiting gas.

Figure 5:
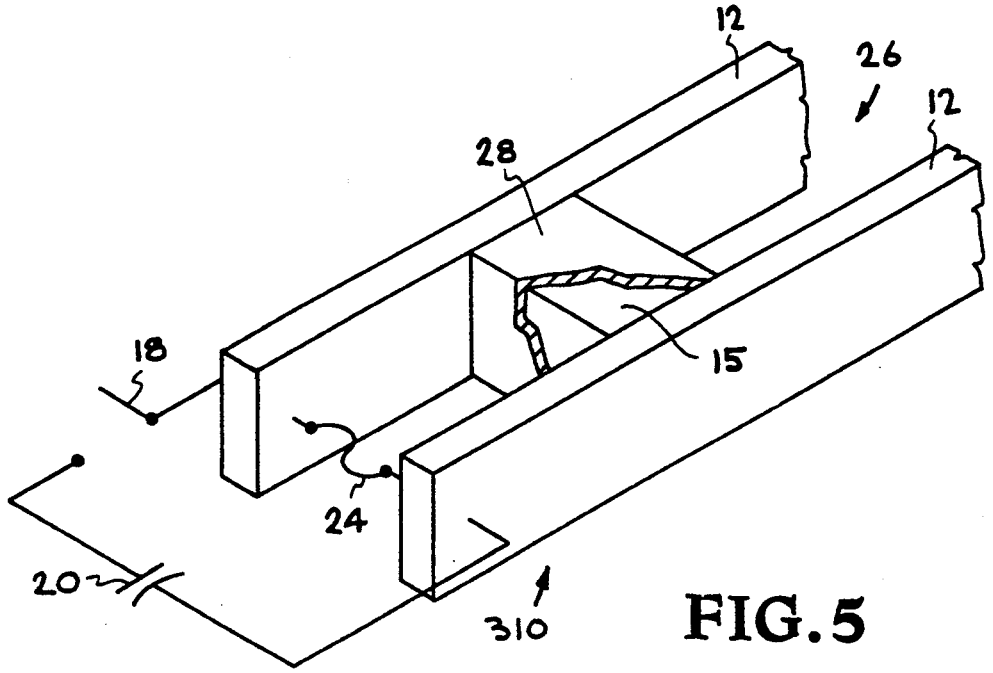
FIG. 5 is a perspective view of a railgun projectile for reducing secondary restrike.

Referring to FIG. 5, a projectile 15 is coated with the breakdown inhibiting material 28 such that when the projectile is accelerated, it heats up causing the material to vaporize and forms breakdown inhibiting gas in the chamber 26. The projectile 15 may also be made from a material 28 which contains breakdown inhibiting gas or the projectile 15 may be impregnated with the breakdown inhibiting gas so that transpiration occurs when the projectile 15 is heated during the acceleration process.

Referring to FIGS. 6–9, another approach for dealing with the restrike problem is disclosed: the projectile itself is configured such that the projectile introduces the breakdown inhibiting gas into the accelerator system 10 or is configured such that a breakdown inhibiting gas does not have to be used.

Figure 6A:
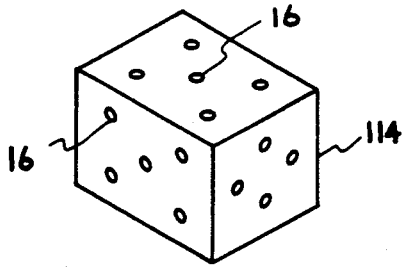
FIGS. 6*a* and 6*b* are perspective views of still another railgun projectile for reducing restrike.
Figure 6B:
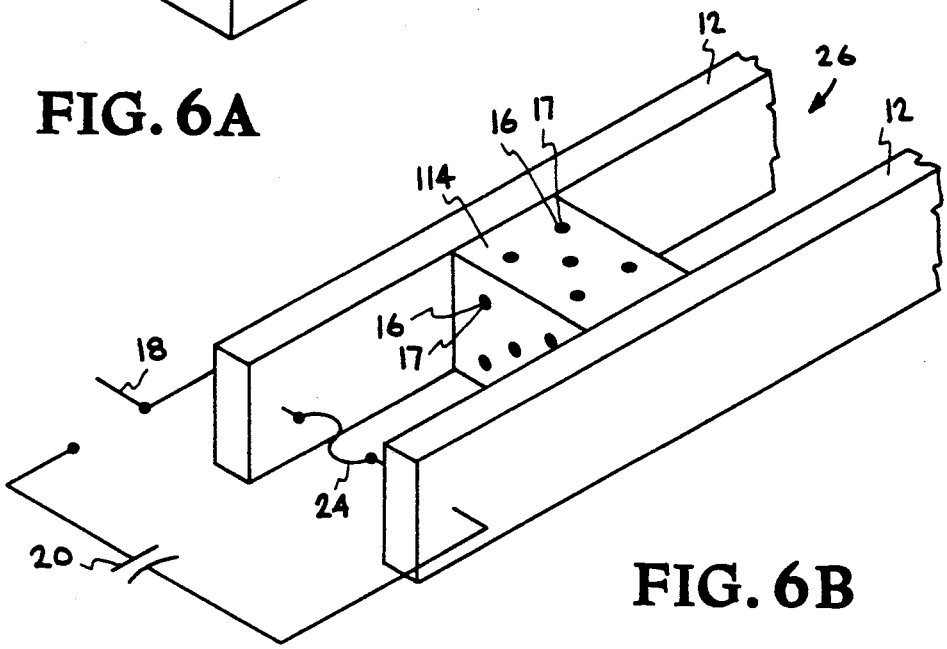

For example, as shown in FIGS. 6A and 6B, the projectile 114 may also be designed to have pores, inlets, or nozzles 16. Like the rails 12, the pores 16 are initially sealed with a wax, grease, or oil 17 and the projectile 114 has a chamber inside for holding the breakdown inhibiting gas. The gas is released into the railgun barrel 26 after the projectile 114 is accelerated and the heat from the arc or friction with the barrel 26 cause the wax or oil 17 to vaporize, thus permitting the breakdown inhibiting gas to be released into the chamber 26 through the pores 16.

Figure 7:
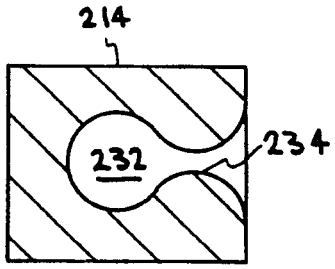
FIG. 7 is a perspective view of a railgun projectile designed to reduce restrike.

Referring to FIG. 7, the rear of the projectile 214 has a pear-shaped cavity 232 with a constricted neck 234. The purpose of the constricting neck 234 is to control gas expansion and to cool the gas. When the projectile 214 is accelerated, the armature 3 forms inside the cavity 232. The ablation products 4 get compressed inside the cavity 232 and exit through the neck 234. The constricting neck 234 causes the gas to expand as it exists cavity 232, close to the end of the projectile 214. As the gas leaves the constricting neck 234, it cools, and, therefore, is less likely to conduct current thereby reducing the chances that a secondary arc will form.

Figure 8:
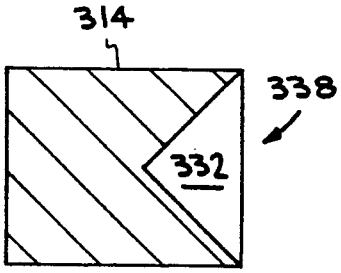
FIG. 8 is a perspective view of another railgun projectile designed to reduce restrike.

Similarly, referring to FIG. 8, a skirted projectile 314 having a V-shaped cavity 332 is illustrated. The cavity 332 has an open neck 338 approximately the same width as the projectile 314 itself. Upon acceleration by the plasma arc, an armature 3 forms inside the V-cavity 332 and thus the skirted projectile 314 shields the rails 12 (not illustrated) from the armature 3, thereby reducing the ablation 4 off the rails 12 and preventing the ablation products 4 from aiding in the formation of restrike.

Figure 9:
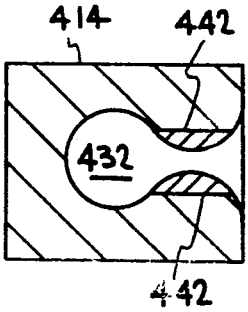
FIG. 9 is a perspective view of yet another railgun projectile for reducing restrike.

Referring to FIG. 9, the projectile 414 having a cavity 432 is either impregnated with, or made from, a material containing breakdown inhibiting gas which vaporizes when the projectile 414 is accelerated by the plasma arc. The projectile 414 has an additional amount of sacrificial material 442 which is designed to be ablated by the plasma arc. The sacrificial material 442 can be located anywhere on the projectile 414 where it will be eroded by the plasma arc. Since the sacrificial material 442 is made from a material having breakdown inhibiting gas, or a material impregnated with the breakdown inhibiting gas, it leaves a residue of the gas in the accelerator behind the accelerating projectile 414.

Having thus described the invention, it is recognized that those skilled in the art may make various modifications or additions to the preferred embodiments chosen to illustrate the invention without departing from the spirit and scope of the present contribution to the art. Accordingly, it is to be understood that the procedure sought and to the be afforded hereby should be deemed to extend to the subject matter claimed and all equivalents thereof within the scope of the invention.

What is claimed is:

1. In a railgun, an elecromagnetic projectile accelerator having a pair of parallel conducting rails for guiding a projectile and means for energizing the rails to form a plasma arc directly behind the projectile to cause the projectile to accelerate its travel along the rails, wherein the improvement comprises:

a coating containing breakdown inhibiting gas on portions of the accelerator, the coating being vaporized when the plasma arc passes thereby releasing the gas for preventing secondary voltage breakdown and for preventing a secondary arc from forming directly behind the accelerating projectile.

2. The apparatus of claim 1, wherein the breakdown inhibiting gas is a compound containing at least one halogen atom.

3. The apparatus of claim 1, wherein the breakdown inhibiting gas is an electron gathering gas.

4. The apparatus of claim 2, wherein the breakdown inhibiting gas is selected from the group consisting of $SF_6$, FREON, fluorine, hydrogen mixed with a compound containing at least one halogen atom, helium mixed with a compound containing at least one halogen atom, and nitrogen mixed with a compound containing at least one halogen atom.

5. A method for preventing secondary voltage breakdown and a secondary arc from forming behind an electromagnetic projectile passing between two parallel spaced apart conducting rails in an electromagnetic projectile accelerator having a means for energizing the rails to form a plasma arc directly behind the projectile, to cause the projectile to accelerate its travel along the rails comprising the step of:

introducing a sufficient amount of a secondary voltage breakdown inhibiting gas in between the rails behind the accelerating projectile for preventing the secondary arc from forming behind the projectile, the gas being a compound containing at least one halogen atom;

further comprising the step of:

coating the portions of the accelerator which come in contact with the plasma arc with a material which vaporizes when the arc passes.

6. The method of claim 5, wherein the gas is introduced after the projectile passes the coated portion of the accelerator.

7. A method of preventing secondary voltage breakdown and a secondary arc from forming behind a projectile passing through a projectile accelerator of a railgun having two parallel rails, comprising the steps of:

accelerating the projectile between the rails by a plasma arc directly behind the projectile; and preventing the formation of a secondary arc behind the projectile by introducing a sufficient amount of a breakdown inhibiting gas between the rails behind the accelerating projectile, the gas being a compound containing at least one halogen atom;

wherein the introducing of gas comprises the step of:

introducing a vaporizing film on regions of the rails that come in contact with the plasma arc.

8. A method of preventing secondary voltage breakdown and a secondary arc from forming behind a projectile passing through a projectile accelerator of a railgun having two parallel rails, comprising the steps of:

accelerating the projectile between the rails by a plasma arc directly behind the projectile; and preventing the formation of a secondary arc behind the projectile by introducing a sufficient amount of a breakdown inhibiting gas between the rails behind the accelerating projectile, the gas containing at least one halogen atom;

wherein the step of introducing the gas is carried out by transpiration due to heating of inhibiting gas containing material adjacent the plasma arc.

9. The method of claim 8, wherein at least the rails are impregnated with the breakdown inhibiting gas, and upon heating of the rails by the plasma arc, a gas is formed behind the accelerating projectile.

* * * * *